US012624866B2

(12) United States Patent
Matalucci et al.

(10) Patent No.: US 12,624,866 B2
(45) Date of Patent: May 12, 2026

(54) ENERGY EFFICIENT PULSING THERMOELECTRIC SYSTEM

(71) Applicant: MIMiC Systems Inc., New York, NY (US)

(72) Inventors: Berardo Matalucci, New York, NY (US); Theodorian Borca-Tasciuc, Troy, NY (US)

(73) Assignee: MIMIC Systems Inc., New York, NY (US)

( * ) Notice: Subject to any disclaimer, the term of this patent is extended or adjusted under 35 U.S.C. 154(b) by 471 days.

(21) Appl. No.: 18/274,704

(22) PCT Filed: Mar. 3, 2022

(86) PCT No.: PCT/US2022/018752
§ 371 (c)(1),
(2) Date: Jul. 27, 2023

(87) PCT Pub. No.: WO2022/187522
PCT Pub. Date: Sep. 9, 2022

(65) Prior Publication Data

US 2024/0093926 A1 Mar. 21, 2024
US 2024/0295351 A9 Sep. 5, 2024

Related U.S. Application Data

(60) Provisional application No. 63/156,478, filed on Mar. 4, 2021.

(51) Int. Cl.
*F25B 21/02* (2006.01)
*F25B 21/04* (2006.01)

(52) U.S. Cl.
CPC ..... *F25B 21/02* (2013.01); *F25B 21/04* (2013.01); *F25B 2321/021* (2013.01); *F25B 2321/0212* (2013.01); *F25B 2500/18* (2013.01)

(58) Field of Classification Search
None
See application file for complete search history.

(56) References Cited

U.S. PATENT DOCUMENTS 3,445,688 A 5/1969 Armstrong
4,554,793 A * 11/1985 Harding, Jr. ..... G01N 25/68 73/29.03

(Continued)

FOREIGN PATENT DOCUMENTS

CN 1094500 A * 11/1994 ..... B64F 1/362
JP H11344578 A1 * 12/1999

(Continued)

OTHER PUBLICATIONS

International Searching Authority, International Search Report and Written Opinion, dated May 18, 2022, for International Application No. PCT/US2022/018752, 8 pages.

(Continued)

*Primary Examiner* — Jenna M Maroney
(74) *Attorney, Agent, or Firm* — Maschoff Brennan; Benjamin Charkow

(57) ABSTRACT

A method for increasing the performance of a thermoelectric system with one or more thermoelectric assemblies to provide heating, cooling, and ventilation through electrical pulsing. The thermoelectric assemblies are individually controllable with constant or pulsing controls so that the performance of the thermoelectric system can be increased. In a multi-assembly system, the thermoelectric system is comprised of thermoelectric assemblies, a control unit that determines the optimal pulsing conditions, and fans to supply and exhaust heating or cooling to an occupied space.

6 Claims, 9 Drawing Sheets

(56) References Cited

U.S. PATENT DOCUMENTS 4,585,002 A * 4/1986 Kissin ..... A61F 7/007 607/96
5,515,238 A * 5/1996 Fritz ..... H10N 10/17 136/203
5,890,371 A 4/1999 Rajasubramanian et al.
6,000,225 A * 12/1999 Ghoshal ..... H10N 10/17 62/3.7
6,119,460 A * 9/2000 Huang ..... H01L 21/67103 62/3.3
6,418,728 B1 * 7/2002 Monroe ..... F24F 5/0042 62/3.2
6,951,114 B2 10/2005 Grisham et al.
7,510,303 B2 * 3/2009 Jonsson ..... H10N 10/00 362/373
7,975,493 B2 * 7/2011 Saad ..... G05D 23/1919 62/157
9,115,919 B2 8/2015 Ilercil
9,685,599 B2 * 6/2017 Petrovski ..... F25B 21/02
10,982,883 B1 * 4/2021 Ilercil ..... F25B 21/02
2002/0121094 A1 * 9/2002 VanHoudt ..... H10N 10/00 62/3.3
2003/0097845 A1 * 5/2003 Saunders ..... F25B 21/04 62/235.1
2005/0039465 A1 * 2/2005 Welch ..... F25B 21/04 62/3.7
2005/0076944 A1 * 4/2005 Kanatzidis ..... H10N 10/852 136/239
2005/0193742 A1 9/2005 Arnold
2005/0235652 A1 * 10/2005 Iwasaki ..... B41J 29/377 62/3.7
2006/0032238 A1 * 2/2006 Uchida ..... H04B 10/572 62/3.7
2008/0086981 A1 4/2008 Kilkis et al.
2010/0132380 A1 6/2010 Robinson
2011/0114284 A1 5/2011 Siegenthaler
2013/0086923 A1 * 4/2013 Petrovski ..... H10N 10/01 62/3.61
2013/0108473 A1 5/2013 Tamminen et al.
2015/0082811 A1 * 3/2015 Rangarajan ..... G06F 1/324 62/3.7
2017/0242048 A1 * 8/2017 Sommer ..... G01P 15/02
2019/0137123 A1 5/2019 Matalucci et al.
2020/0133427 A1 * 4/2020 Billington ..... F25B 21/04
2021/0399186 A1 * 12/2021 Warren ..... H10N 10/80

FOREIGN PATENT DOCUMENTS

JP 2006073628 A 3/2006
KR 20150040405 A 4/2015

OTHER PUBLICATIONS

International Bureau of WIPO, International Preliminary Report on Patentability, dated Sep. 14, 2023, for International Application No. PCT/US2022/018762, 7 pages.
Extended European Search Report, dated Jun. 26, 2024, for EP Application No. 22764077.8, 10 pages.

* cited by examiner

ENERGY EFFICIENT PULSING THERMOELECTRIC SYSTEM

FIELD OF THE INVENTION

The present invention relates generally to a thermoelectric system with improved efficiency through the use of a controller that provides pulsing current.

BACKGROUND OF THE INVENTION

With global urbanization, humans spend more time indoors, living in highly thermally controlled environments. The use of energy intensive, refrigerant-based technologies to provide this thermal control increases greenhouse gas (GHG) emissions and has detrimental effects on global warming. For such thermally controlled environments, there is typically one or more habitable spaces (i.e., an occupied or interior space), where heat transfer is controlled, and an exterior environment where heat is sourced or rejected.

Weather conditions, including solar radiation, tend to change throughout the year, months, and even on an hourly basis making it difficult to control how much heat to provide or remove from an occupied space to ensure thermal comfort. Since humans each experience thermal comfort uniquely due to their physiological and psychological unique responses, there exists the need to develop heating and cooling systems capable of predicting, responding, and adapting to a variety of human preferences while responding to fast-changing weather conditions.

Numerous techniques have been developed since the beginning of recorded time to provide heating and cooling to occupants. Modern techniques which provide heating and cooling to occupants include the use of vapor-compression technologies for space heating and cooling. This technique has been the dominant system over many decades, and it has been proven to be effective for building applications. However, this method is limited in providing variable temperature of the air that exits the coils, due to limitations of the vapor-liquid cycle of the employed refrigerants (i.e., the temperature at which refrigerants change phase). This lack of variability can cause thermal comfort issues to users, such as thermal asymmetry, or the inability to distribute or remove heat uniformly, resulting in occupied areas that are either too cold or too warm at certain times. As a result, the ability to respond to varying user preference and adapting to diverse ambient conditions is limited with such a system.

Another technique to provide heating and cooling is through the use of a thermoelectric modules (i.e., solid-state heat pump or thermoelectric heat pumps), which carries heat from one zone to another through a solid-state medium (such as semiconductors, i.e., bismuth telluride) using electricity, to maintain a precise temperature in an occupied space and to avoid using ozone-depleting materials, like refrigerants. However, thermoelectric modules suffer from low energy efficiencies.

Generally, the amount of heat that can be pumped across a thermoelectric device is proportional to the amount of electrical current required to operate the module itself, but it reaches a point of diminishing return (i.e., where the thermoelectric device needs to work so hard to dissipate more heat that additional heat cannot be pumped without the expenditure of an impractical amount of energy).

Efforts have been made in the prior art to increase the efficiency the thermoelectric modules by pulsing the electrical current across the thermoelectric module instead of applying a constant current. A pulsing (i.e., pulsing electric current) generates a transient effect within the thermoelectric module whereby there are two distinct phases: a) an increase in heat pumped and temperature differential across the thermoelectric module; and b) a decrease of heat pumped and a reduction of temperature differential across the thermoelectric module due to the end of the electrical pulse. However, the prior art to date only takes into account the efficiency of the thermoelectric modules when developing the control algorithm to use in connection with the pulsing of electrical current. However, for thermal comfort applications, it must be understood how electrical pulsing affects the supply and removal of heat from an occupied space.

Additionally, these prior art thermoelectric heat pump systems do not respond to dynamic conditions (i.e., the occupant temperature preference or ambient conditions), because they have been designed around fixed boundary conditions (i.e., temperature differential across the module).

Accordingly, there is a need for improving the efficiency of a thermoelectric module and to develop a system that can respond to dynamic conditions while maintaining the desired heating or cooling capacity.

SUMMARY OF THE INVENTION

A method to improve the efficiency of a thermoelectric system in accordance with an embodiment of the present invention is provided. The thermoelectric system comprises one or more thermoelectric assemblies. Each thermoelectric assembly is comprised of at least one thermoelectric module (also known as a thermoelectric device) with two heat exchangers, one on each side of the thermoelectric module. In embodiments, each heat exchanger is comprised of metal fins in contact with the outer surface of the thermoelectric heat pumping modules. The thermoelectric system also comprises a control unit to operate the thermoelectric assemblies and control their performance.

The method uses a control system for the thermoelectric system that maximizes the efficiency of the system by supplying intermittent electric pulsing to the one or more thermoelectric assemblies within the thermoelectric system in response to dynamic inputs. In embodiments, non-limiting examples of such dynamic inputs include diurnal variation of outdoor air temperature, effect of direct solar radiation, change in occupancy of the habitable space, change in temperature set-point decided by the occupant, change level of dehumidification required, and the like. One of ordinary skill in the art would recognize that the method can be used for Heating, Air Conditioning and Ventilation (HVAC) applications as well as refrigeration, or production of heat using a source of heat with variable conditions.

In embodiments, there is provided a method for improving the efficiency of a thermoelectric system through the use of a controller adapted for controlling a thermoelectric assembly, the controller including an input configured to receive power to power the controller, an output configured to supply power to a thermoelectric assembly and a processor configured to control the power that is supplied to the thermoelectric assembly. The power can be supplied using a continuous steady supply of power, a plurality of intermittent pulses, or a combination thereof. The thermoelectric assembly has a coefficient of performance defined by the cooling or heating rate (i.e., the power pumped by the thermoelectric assembly for cooling or heating) divided by the power supplied to the thermoelectric system.

In embodiments, the controller supplies power to the thermoelectric assembly in a plurality of intermittent pulses only. In embodiments, the intermittent pulses are supplied for a duration (i.e., a pulse duration) in a range of 5 to 20 seconds with an interval (i.e., a pulse interval) of 10 to 20 seconds between each consecutive pulse of the intermittent pulses.

In embodiments, the controller adjusts the duration of the intermittent pulses or the interval of the intermittent pulses to increase the coefficient of performance of the thermoelectric assembly.

In embodiments, a thermoelectric system for increasing the efficiency of the system itself includes a power supply, a controller connected to the power supply, and a solid-state heat pump (such as a thermoelectric assembly) connected to the controller. The controller supplies power to the thermoelectric assembly using a plurality of intermittent pulses. In embodiments, the controller supplies intermittent pulses to the thermoelectric assembly for a duration in a range of 5 to 20 seconds with an interval of 10 to 20 seconds between each consecutive pulse of the intermittent pulses.

In embodiments, there is provided a method of controlling a thermoelectric assembly, the method including the steps of powering a controller using a power supply and using a controller powered by the power supply to power a thermoelectric assembly. The power from the controller is supplied using a plurality of intermittent pulses. In embodiments, the intermittent pulses are supplied for a duration in a range of 5 to 20 seconds with an interval of 10 to 20 seconds between each consecutive pulse of the intermittent pulses.

In embodiments, a Functional Control Unit (FCU) powers and controls the thermoelectric assemblies and a Functional Operative Unit (FOU) provides information to the FCU.

The FOU determines the necessary heat transfer rate and air flow rate within the occupied space based on different inputs, such as interior and exterior air temperatures, desired interior temperature setpoint, desired air flow rate, and like. The FOU provides the required heat transfer rate and air flow rate to the FCU, which determines the intermittent pulsing to be supplied to the one or more thermoelectric assemblies. In embodiments, the intermittent pulsing is supplied in waveform arrangement. The FOU determines the most energy efficient intermittent pulsing, in terms of waveform, intensity and duration.

The thermoelectric assemblies provide or remove heat from an occupied space through an air-side heat exchanger and a fan. The thermoelectric assemblies pump or reject (i.e., expel) heat to an exterior space through an air-side heat exchanger and fan. Unlike refrigerant-based systems using a compressor that can only operate at certain air temperature conditions (for example, the temperature at which the refrigerant changes from gaseous to liquid, thereby absorbing or releasing heat), the present invention can provide variable temperature modulation at the air-side heat exchanger supply to meet user preferences and adjust the heating or cooling capacity under fluctuating indoor and outdoor weather conditions, such as direct solar radiation, change in temperature setpoint by the user, and diurnal changes in outdoor temperature.

Even with the increased efficiency of the thermoelectric system including one thermoelectric assembly in accordance with the present invention, the thermoelectric assemblies typically operate to adjust the air temperature (i.e., create a temperature differential) within 20° C. In embodiments, to increase the temperature differential capable from the thermoelectric system, the thermoelectric assembly is comprised of one heat exchanger per side and two or more thermoelectric modules stacked on top of each other, whereby the hot side of a thermoelectric module is arranged to be coplanar with the cold side of the adjacent thermoelectric module stacked above it. In an embodiment, stacks of thermoelectric modules are powered and controlled individually by the FCU. In an embodiment, the stacks of thermoelectric modules are powered and controlled together by the FCU.

In embodiments, the number and distribution of the thermoelectric assemblies affect the overall capacity of the HVAC system. In accordance with the present invention, a heat transfer density typically ranging from 5 to 10 W/cm$^2$ is used for operating the thermoelectric assemblies.

The thermoelectric assemblies utilize electrical current to transport beat from a cold zone to a hot zone, on opposite sides of the solid-state device. Depending on the direction of the electrical current, heat can be transported in either direction allowing for supplying heat to (i.e., heating) or removing heat from (i.e., cooling) an occupied space.

In embodiments, the thermoelectric assemblies are cascaded (i.e., connected in series) in a counter-flow arrangement, which increases the efficiency of the system by dividing the temperature lift across multiple steps, thereby operating the thermoelectric modules more efficiently. Under this arrangement, the FCU can power the thermoelectric assemblies with similar pulsing because the temperature differentials are divided equally.

In embodiments, the HVAC system constructed in accordance with the present invention is set up with a counter-flow fluid stream. In accordance with this embodiment, an outside fluid, which is preferably water but can be any type of fluid including air, steam, or ammonia, flows through a heat exchanger (i.e., a finned air-side exchanger) to the inside of a room over a series of thermoelectric assemblies while inside liquid flows to a location outside the room over the opposite sides of the thermoelectric assemblies.

In embodiments, the thermoelectric assemblies contain sensors which measure the temperatures of the two heat exchangers. The sensors feed information directly to the FOU, which registers the operating conditions of each thermoelectric assembly, relative to the fluid mass rate in the media, the desired output temperature and air flow of the system that are set by an occupant.

Because the thermoelectric assemblies are connected in series, the FCU adjusts the power (i.e., the electrical current or the voltage) provided to the thermoelectric module to maximize the Coefficient of Performance (COP) or efficiency of the HVAC system. The COP is defined as the heating or cooling rate divided by the power supplied to the thermoelectric assemblies. The FCU provides power to the thermoelectric assemblies to maximize the COP of HVAC system, and it modulates the voltage across the thermoelectric assemblies, the directionality of the electric power, as well as the frequency of the operating states.

In accordance with the teachings of the present invention, these features produce an energy efficient system and provide varying heating or cooling capacities depending on the number of thermoelectric assemblies included in the thermoelectric system.

In accordance with the present invention, the FCU determines the signal conditioning parameters such as waveform type, intensity, pulsing duration, and pulsing interval. The signal conditioning parameters are based on inputs registered by the FOU, such as temperature differentials across each thermoelectric assembly, thermal inertia, air flow at the air-side heat exchangers, and desired temperature at the supply.

In embodiments, different frequencies of the same waveform are used to increase the efficiency of the thermoelectric assemblies. In embodiments, signals using a 4A baseline electrical current followed by a 10A pulsing current with varying intervals are used to create square waveforms of varying frequencies, which can be in the range of 1 Hz to 0.01 Hz. In embodiments, voltage is applied using a square waveform, providing a gradual rise in the difference of temperatures between the cold and hot zones, which are offset depending on the thermal inertia of the fluid within the heat exchangers.

In embodiments, the current is applied to the thermoelectric assemblies in pulses using intermittent voltage to provide equivalent current and the like. The pulsing of voltage supplies heat to the portion of the fluid flowing within the heat exchanger that is passing the thermoelectric assembly when pulsed.

In embodiments, an increased pulse of current is for a duration (i.e., a pulsing duration or "PD") in a range of 2 to 180 seconds, and preferably 5 seconds, with an intensity (i.e., a pulsing intensity or "PI") lasting from a range of 2 to 180 seconds, and preferably for 20 seconds. A pulsing duration of preferably 5 seconds and a pulsing intensity of preferably 20 seconds is used to increase the COP of the HVAC system. Efficiency is optimized at these parameters because while an increase in electrical current generates a greater heat transfer and temperature differential across a thermoelectric assembly, it also decreases the efficiency (i.e., COP) of the system as the thermoelectric assembly needs to work harder to dissipate more heat. Applying the optimized pulsing duration and intensity in accordance with the present invention provides for a thermoelectric assembly operating with greater efficiency under the desired temperature differentials and heat transfer.

In embodiments with a stacked assembly of thermoelectric modules, different pulsing intensities and duration are applied to the different stacks of modules. In embodiments with two stacks of thermoelectric modules, one stack of the thermoelectric modules has a pulsing duration in the range of 5 to 50 seconds and preferably 15 seconds, and a pulsing interval in a range of 2 to 50 seconds and preferably 5 seconds. The second stack of the thermoelectric modules has a pulsing duration in the range of 5 to 15 seconds and preferably 5 seconds, and pulsing interval in a range of 5 to 60 seconds and preferably 15 seconds. This difference in pulsing duration and intensity between the first and second stacks increases the temperature differential across the assembly, thereby the cooling or heating capacity, without decreasing the COP because the two stacks sequentially pump heat without consuming electrical power concurrently.

In embodiments, the HVAC system includes at least a power supply unit, an FCU and FOU unit, a thermoelectric assembly, and two fans. In embodiments, the system is powered electrically by the unit power supply, either by direct or alternate current. In embodiments, the system includes a compact HVAC unit that is configured to be placed inside an occupiable room and connected to a building envelope opening with a dual venting system which combines heat rejection and fresh air intake. In embodiments, the compact HVAC unit is configured to be placed within the window to absorb or reject heat, as well as provide fresh air intake. In embodiments, the compact HVAC element is configured to be placed inside a through-the-wall sleeve as a packaged terminal air conditioner unit. In embodiments, the system is used for providing cooling only. In embodiments, the system is used for providing heating only.

As one non-limiting example of how the system may be used, it may be used in habitable spaces for providing ventilation, heating, and cooling. Alternatively, as another example, the present invention may be used with recreational vehicles, automobiles, trains, buses, underground trains, airplanes, and in all spaces where providing heating, cooling, and ventilation is required.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying figures wherein.

DETAILED DESCRIPTION OF THE EXEMPLARY EMBODIMENTS

Figure 1:
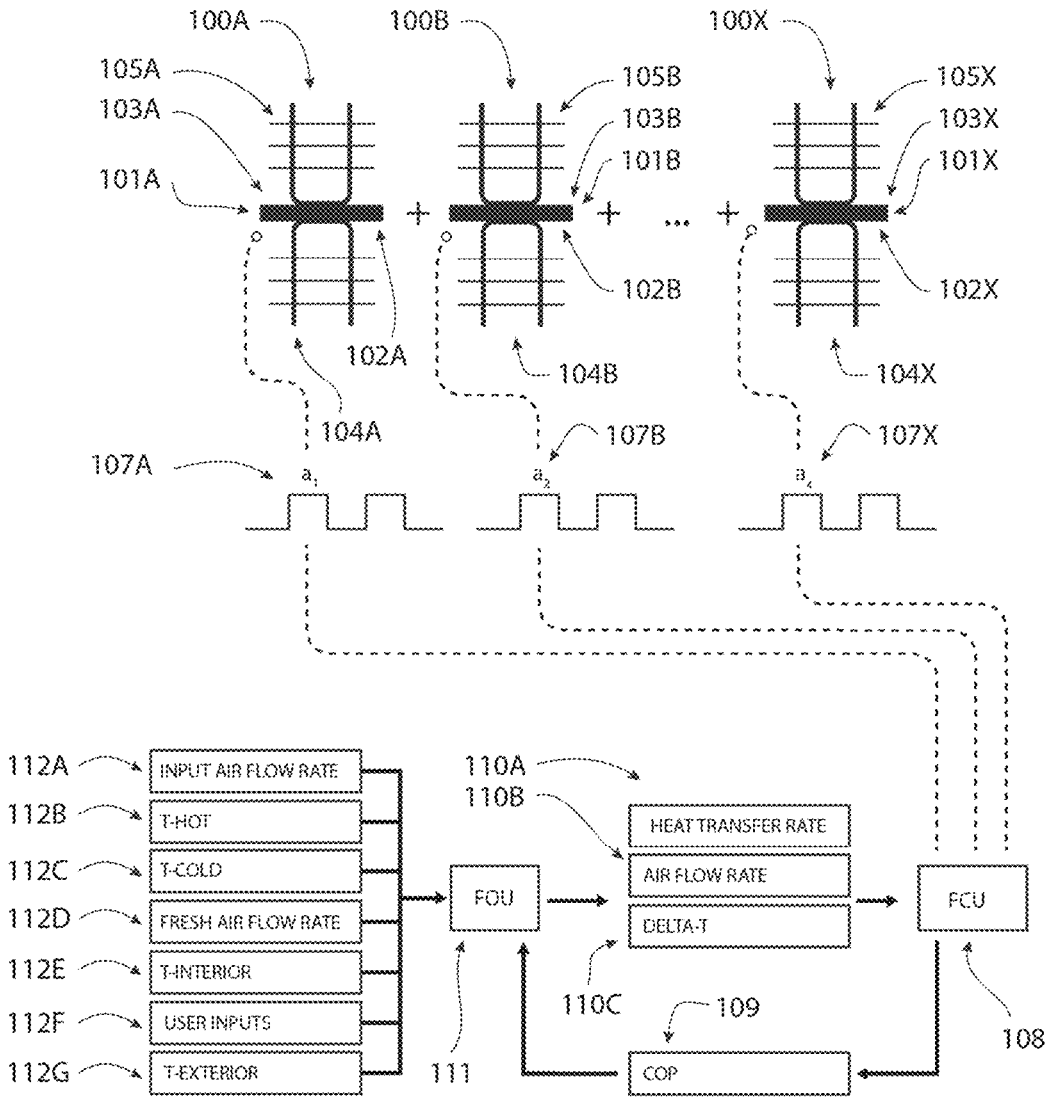
FIG. 1 is an illustration of the proposed control schematic of the system, wherein the FOU powers the thermoelectric assemblies based on optimal operating conditions in accordance with embodiments of the present invention.

FIG. 1 illustrates the proposed control schematic of a system in accordance with embodiments of the present invention, wherein the FCU powers the thermoelectric assemblies based on optimal operating conditions.

In embodiments, a thermoelectric assembly (i.e., a solid-state thermoelectric assembly, or solid-state heat pump) includes one or more thermoelectric modules, each with two heat exchangers. The embodiment shown in FIG. 1 illustrates an array of X thermoelectric assemblies (three assemblies are shown in the illustration, but any number of X thermoelectric modules between 1 and X can make up the thermoelectric assembly).

In the embodiment shown in FIG. 1, thermoelectric modules 101A, 101B, 101X contain thermoelectric legs which generate 10 W/cm$^2$ at a temperature differential of 20° C. based on the number, layout, and thickness of the thermoelectric modules. Thermoelectric modules 101A, 101B, and 101X are contained within finned metallic heat exchangers 105A, 105B, and 105X, conventionally called the hot side, in contact with hot side 103A, 103B and 103X of thermoelectric module 101A, 101B, 101X. Finned metallic heat exchangers 104A, 104B, and 104X, conventionally called the cold side are in contact with cold side 102A, 102B, and 102X of thermoelectric modules 101A, 101B, and 101X. For an exemplary cooling condition, heat is removed from the cold side of thermoelectric modules 102A, 102B, 102X and pumped to the hot side of the thermoelectric modules 103A, 103B, 103X.

As seen in FIG. 1, FCU 108 powers one or more thermoelectric assemblies (shown here as thermoelectric assemblies 100A, 100B, 100X) to find optimal operating conditions. FCU 108 is a programmable electronic control system that powers the thermoelectric assemblies as needed to supply the thermoelectric assemblies with the optimal required power. In embodiments, the system can comprise one thermoelectric assembly (i.e., assembly 100A only), a pair of thermoelectric assemblies (i.e., assemblies 100A and 100B), or any number of assemblies as shown in FIG. 1.

In the embodiment illustrated in FIG. 1, FCU 108 provides power to thermoelectric assemblies 100A to 100X using an intermittent pulsing current 107A to 107X. Pulsing current 107A to 107X is supplied to thermoelectric assemblies 100A to 100X in a specific duration and intensity. The pulsing duration (PD) can range from about 5 to 120 seconds, and is preferably about 20 seconds. The pulsing intensity (PI) can range from about 2 to 60 seconds, and is preferably about 10 seconds.

In the embodiment shown in FIG. 1, the pulsing is applied using a square waveform. However, other waveforms such as sinusoidal, trapezoidal, triangular, and parabolic can be used. In the embodiment shown in FIG. 1, the pulsing duration and intensity 107A. 107B, 107X is the same for each thermoelectric assembly 100A, 100B, 100X. In embodiments (not shown), each thermoelectric assembly can be powered with a waveform of differing intensity and duration. Depending on the boundary conditions at the sides of the heat exchangers (i.e., surface temperature, fluid flow rate, and thermal resistance of the heat exchanger) and the number of thermoelectric modules comprising the thermoelectric assembly, there may be different heat transfer rates across each assembly.

FCU 108 has an internal processing logic that calculates the pulsing frequencies 107A, 107B, and 107X, to maximize Coefficient of Performance (COP) 109 based on target performance provided by FOU 111. The pulsing conditions 107A ($a_1$), 107B ($a_2$), and 107X ($a_x$), are unique for a specific moment in time, and account for the need to deliver the required heat transfer rate 110A, the air flow rate 110B, and provide the necessary temperature differential 110C under the highest COP 109.

FOU 111 calculates the heat transfer rate 110A, air flow rate 110B, and the temperature differential at the supply side (DELTA-T) 110C at intervals ranging from 0.5 seconds to 10 seconds, and preferably 1 second. Within each interval, FOU 111 recalculates these values, one by one or all at once, based on the predicted COP 109 computed by FCU 108. The process is repeated until there is a convergence of the results, whereby the difference between two steps of the calculations of the heat transfer rate 110A, air flow rate 110B, and the temperature differential at the supply side (DELTA-T) 110C is less than 10%.

FOU 111 receives inputs from sensors 112 placed within the HVAC system and receives inputs from an entry dashboard (not shown) within the HVAC system. One sensor measures the air flow rate 112A to be used at the supply side of the HVAC system. The HVAC system (not shown) would incorporate fans and provide treated air into the space and exhaust heat to the outside. One or more sensors measures the temperature of the hot side (sensor 112B) and cold side (sensor 112C) of the thermoelectric assemblies 100A, 100B, and 100X (i.e., hot sides 105A, 105A, 105X and cold sides 104A, 104B, and 104X). Sensor 112D, located within the air recuperator (not shown), measures the fresh air flow rate from the exterior which is mixed with the air from the occupied space to be heated or cooled. Sensor 112E measures the temperature and relative humidity of the air within the occupied space to be heated or cooled. Sensor 112F provides details to FOU 107 about user preferences (user inputs), such as desired temperature setpoint, air flow rate, heating or cooling mode and the like. Sensor 112G measures the outside air temperature and relative humidity.

In embodiments, FCU 108 updates the pulsing duration and intensity supplied to thermoelectric assemblies 100A to 100X every 1 second, but the updating can typically range from 0.5 second to 5 second intervals. FCU 108 maximizes COP 109 based on the required heat transfer rate 110A to be provided to the occupied space (calculated by multiplying the heat transfer coefficient of the heat exchanger with the temperature differential between the heat exchanger and the ambient air temperature), the air flow rate 110B set by the user, and the temperature differential (DELTA-T) 110C calculated between the user input 112F and the interior air temperature (T-Interior) 112E, and the exterior air temperature 112G for heat rejection or source. Using a recursive, trained algorithm such as multi-objective regression, which is known to one of ordinary skill in the art, FCU 108 controls the functionality of each thermoelectric assembly 100A to 100X through the application of pulsing current 107A to 107X. FCU 108 also regulates the polarity of the electrical current 107A to 107X supplied to each thermoelectric assembly. A positive polarity provides for heating across each thermoelectric assembly from thermoelectric module cold side 102A, 102B, and 102X to thermoelectric device hot side 103A, 103B, and 103X in the same direction. A negative polarity (not shown) would result in heat flowing in the opposite direction, resulting in cooling across each thermoelectric assembly (i.e., a removal of heat).

Figure 2:
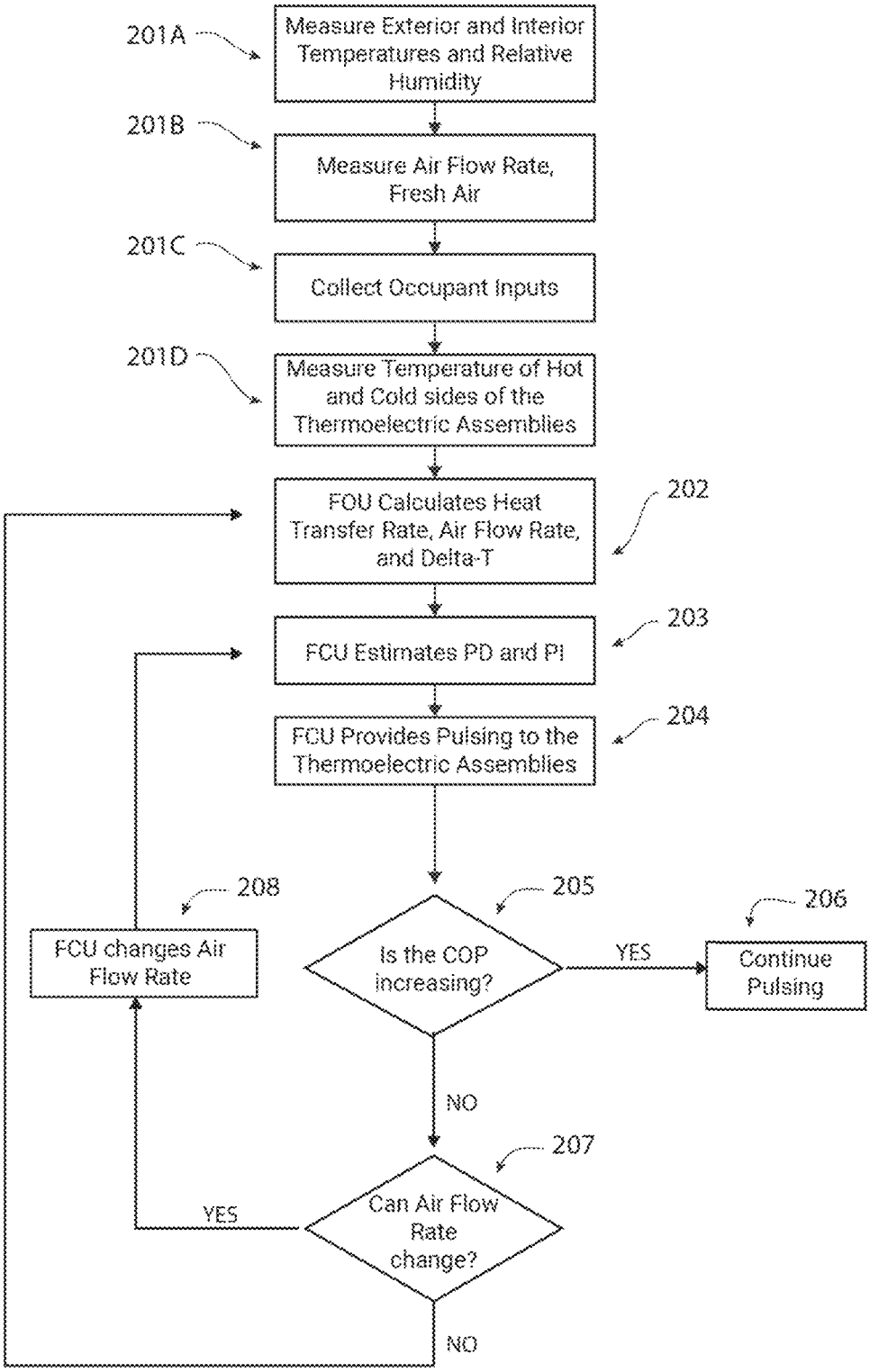
FIG. 2 is a flow chart of a method of controlling a thermoelectric assembly of the system of FIG. 1.

Referring to FIG. 2, a flow chart is shown of an exemplary method of controlling a thermoelectric assembly of the system of FIG. 1. At step 201A, FOU 111 measures the exterior air temperature (using sensor 112G), the interior air temperature (using sensor 112E) and relative humidity (using sensor 112E) every 5 seconds typically, but within a range of 2 seconds to 60 seconds. At step 201B, the input air flow rate 112A at the supply side of the HVAC system and the outside (i.e., exterior) fresh air flow rate 112D (i.e., the fresh air flow rate) coming from outside are measured. At step 201C, FOU 111 collects inputs 112F from the user (i.e., the occupant of the building). These inputs include, but are not limited to, the desired indoor air temperature, mode of operation (i.e., heating or cooling), and desired air flow rate at the supply side of the HVAC system.

At step 201D, FOU 111 measures the temperatures at the hot and cold sides of the thermoelectric assemblies using sensors 112B and 112C respectively.

Once the inputs described above are collected, at step 202, FOU 111 calculates the required heat transfer rate 110A, air flow rate 110B (if not specified by the user), and the required Delta-T 110C (i.e., the temperature differential between the hot and cold sides of the thermoelectric assemblies). Then, at step 203, FCU 108 estimates the PD and PI that should provide the highest COP based on the heat transfer rate, air flow rate, and Delta-T calculated by FOU. The FCU estimates PD and PI using a multi-objective regression, as is known to one of ordinary skill in the art, whereby the value of PD and PI are changed until there is a convergence of results, whereby the difference between two calculations is less than 5%.

Once PD and PI are estimated, FCU 108, at step 204, provides pulsing power to the thermoelectric assemblies. At step 205, FCU 108 calculates COP based on heat transfer rate 110A and the power provided to the thermoelectric devices, with a time frame equal to the sum of PD and PI. If COP is increased from the previous state, the method proceeds to step 206 and FCU 108 continues the pulsing of power to the thermoelectric assemblies using the same PD and PI. If COP does not increase from the previous state, then FCU 108 determines at step 207 if the air flow rate 110B can be changed based on user inputs 112A. If the air flow rate can be changed, then FCU 108 at step 208 increases the air flow rate 110B by 10% and at returns to step 203 to repeat the calculation for the estimated PD and PI at 203. If the air flow rate cannot be changed, then the FCU 208 returns to step 202 as the multi-objective regression was inconclusive, and the process proceeds again to try and recalculate PD and PI parameters that will increase the COP.

Figure 3:
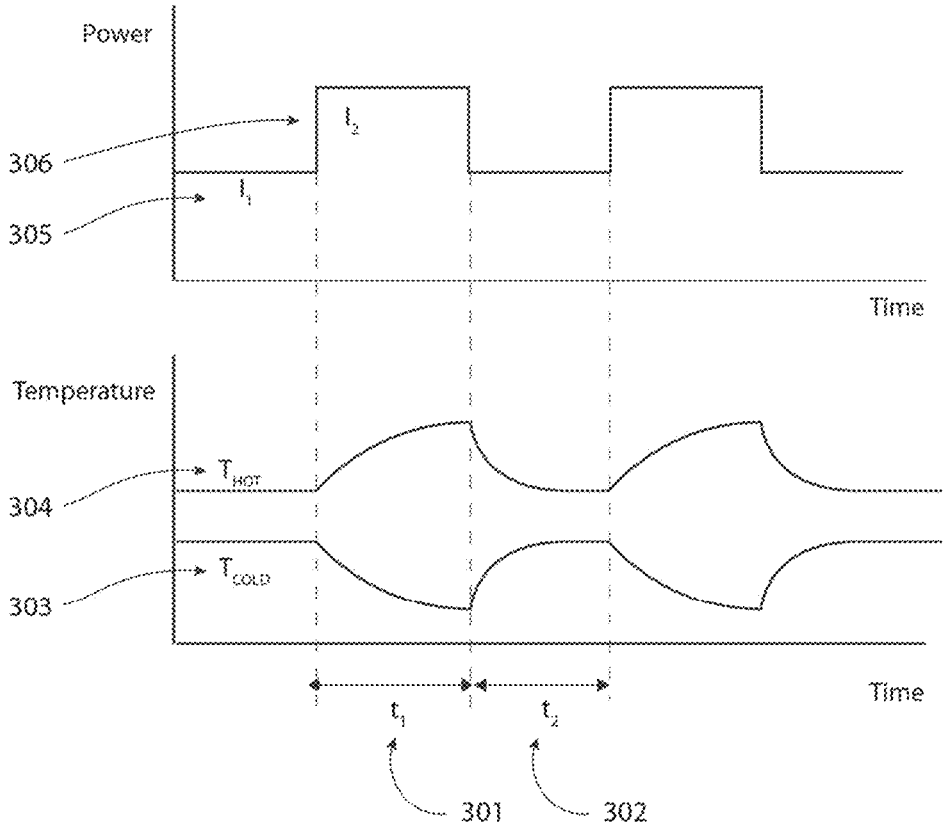
FIG. 3 is an illustration of the change in temperatures at the two sides of a thermoelectric assembly induced by pulsing the electrical current using an exemplary square waveform in accordance with embodiments of the present invention.

Turning to FIG. 3, an illustration of the effect of pulsing of electric current on temperature over time is shown for a single thermoelectric assembly in accordance with embodiments of the present invention. In the embodiment shown in FIG. 3, a constant pulsing is shown. In embodiments, the temperature differential across the thermoelectric modules depends on the weather conditions, the air temperature of the occupied room, and the supply air temperature. Under steady conditions, electrical current (Is) 305 provided to the thermoelectric assembly generates a certain temperature at the cold zone ($T_{cold}$) 303 of the supply air side heat exchanger and a certain temperature ($T_{hot}$) 304 at the hot zone of the exhaust air side heat exchanger. As described above, the overall temperature differentials achieved depend on the electrical power supplied, the air flow rate, the internal thermal capacitance of the liquid medium, and thermal resistance of the heat exchangers.

In embodiments, there is a time lag between the temperatures at the air-side heat exchangers (i.e., $T_{HOT}$ 304 and $T_{COLD}$ 303) and the thermoelectric assembly when a different electrical current is provided. In particular, when a greater electrical current ($I_2$) 306 is provided for a determined time interval ($t_1$) 301, the temperature differentials between 304 and 303 tend to increase in a curvilinear trend, resulting in greater heat transfer at the expense of the energy efficiency as more power is supplied to the system. However, when the electrical current is returned to the initial value ($I_1$) 305, the temperature differentials across the system gradually revert to the initial steady-state condition. During this time ($t_2$) 302, the heat transfer across the system is greater than during the steady-state conditions, increasing the efficiency of the system itself. Pulsing Intensity (PI) and Pulsing Duration (PD) are both illustrated in FIG. 3. PI is defined as the ($t_1$) interval 301 (i.e., the time where pulse $I_2$ 306 is being applied), while the PD is defined as the ($t_2$) interval 302 (i.e., the time between each pulse $I_2$ 306 which corresponds to the time in which current $I_1$ 305 is being applied).

In embodiments, the goal for control unit FCU is to determine a PD and PI that increases the overall efficiency of the system comprised by one or more thermoelectric assemblies when providing heating or cooling. In embodiments, PD is in the range of 2 seconds to 40 seconds, and preferably between 5 s and 20 s. The optimal PD depends on thermal inertia of the system and the heat transfer rate at the exchangers of the of thermoelectric assemblies. In embodiments, PI is in the range of 2 s to 120 s, and preferably between 5 seconds and 20 seconds depending on the heat transfer density of the thermoelectric modules.

In embodiments, different power frequencies of the same waveform are used to provide the PD and PI. In an exemplary embodiment, a square waveform is used. Using different power frequencies of the same waveform increases the performance of the thermoelectric heat pumps.

In a preferred embodiment, a 4A baseline electric current is used followed by a 10A pulsing current with varying intervals. The pulsing current is constructed to generate a sequence of waveforms at specific PD ranges to match the heat pumping capacities with the liquid air flow within the liquid heat exchangers to reduce the power consumed by the system. Once heat is removed from the space, the signal to the thermoelectric assemblies changes to a different duration, returning to $I_1$ 305 electric current as a maintenance mode to provide lower power consumption. The return to the original electric current delays the accumulation of heat in the occupied space. In accordance with the present invention, the compounding effect of the pulsing cycles of each stage (i.e., the total heat transfer rate) varies depending on the fluid flow rate, operating conditions of the adjacent stages, heat rejection at the air sides, ambient conditions, and thermal comfort preferences of occupants.

Figure 4:
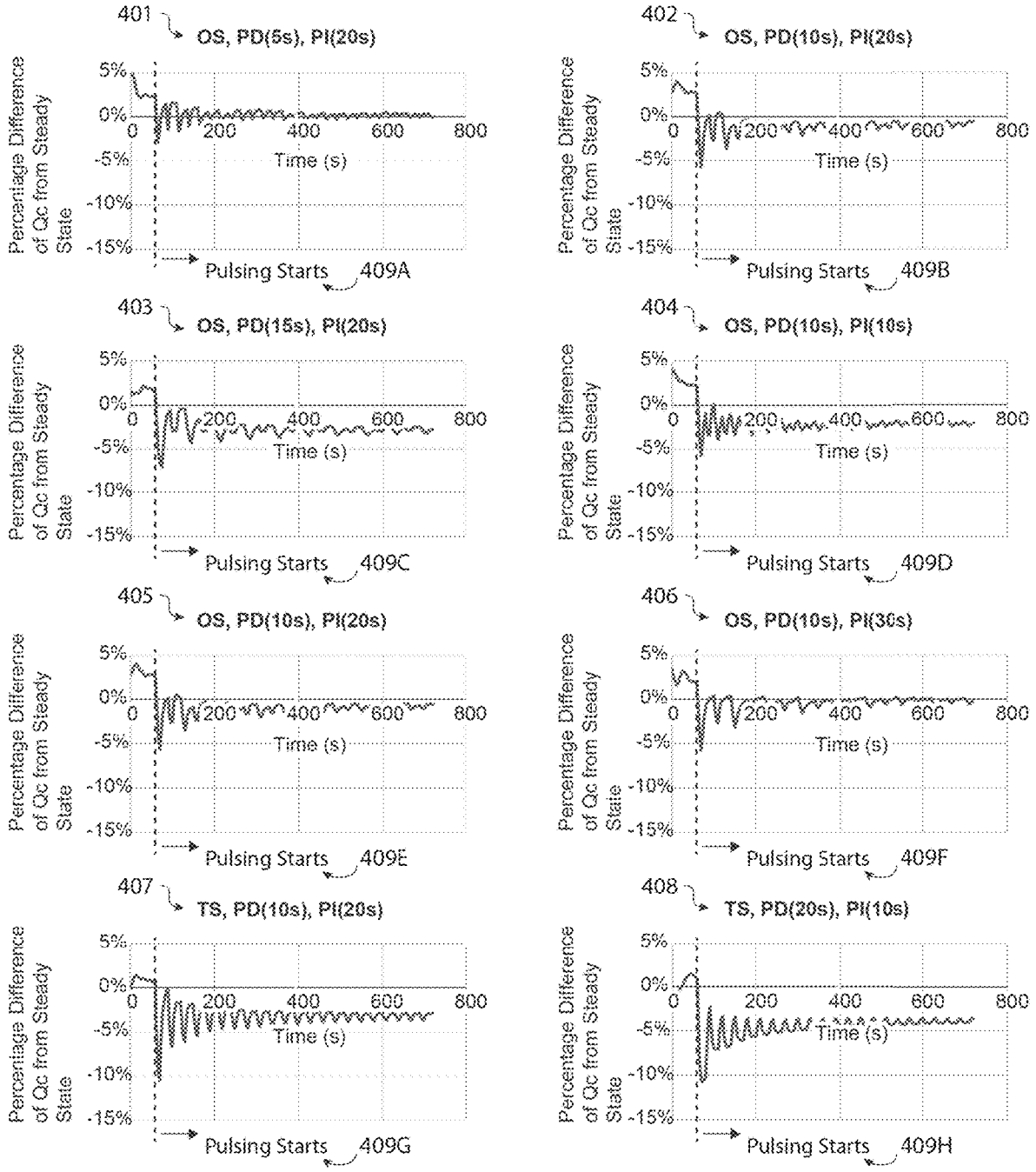
FIG. 4 illustrates the percentage difference between cooling capacity during pulsing and average steady state at a range of currents and varying PD and PI in accordance with embodiments of the present invention.
Figure 5:
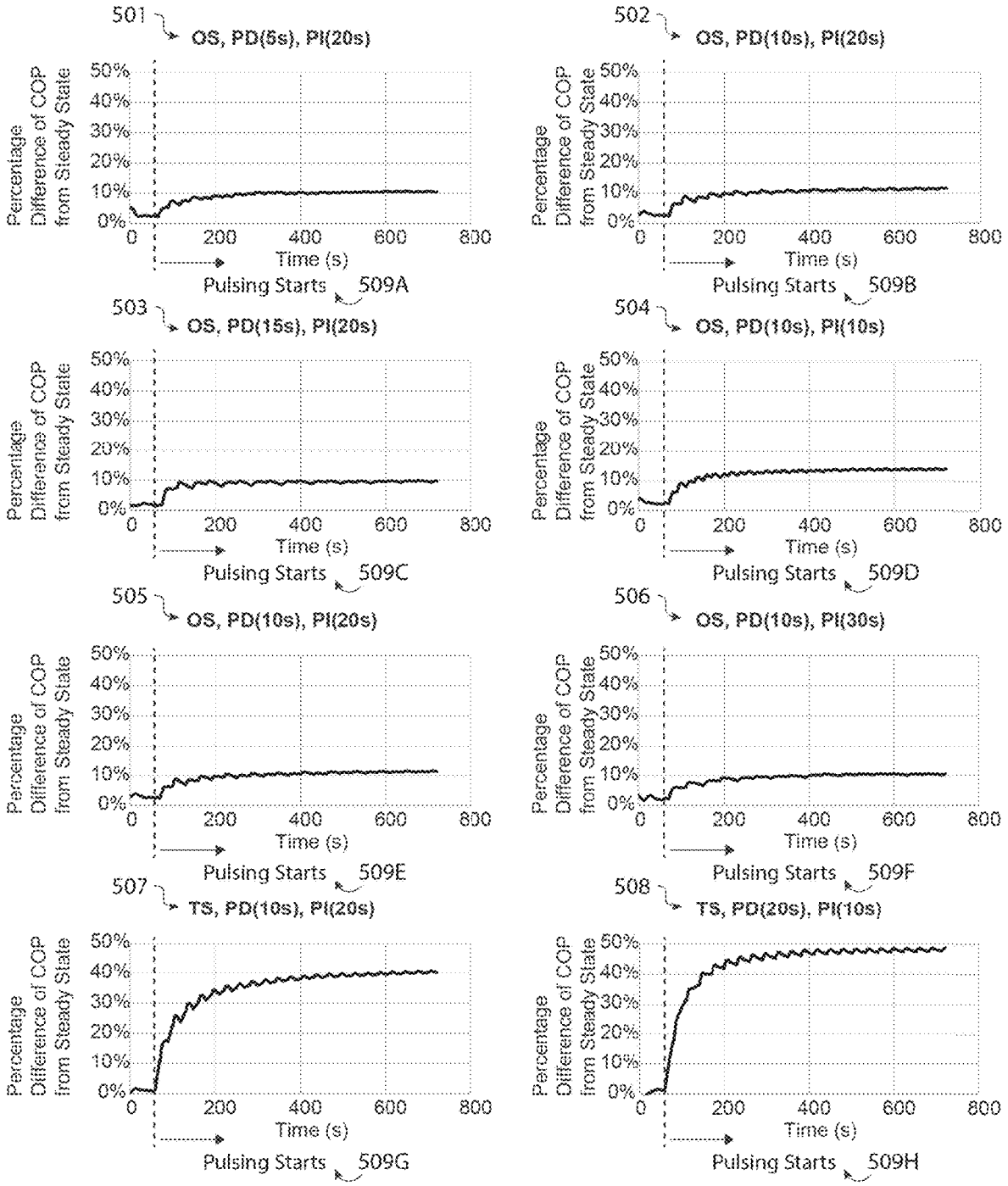
FIG. 5 illustrates the percentage difference between cooling COP during pulsing and average steady state at a range of currents and varying PD and PI in accordance with embodiment of the present invention.

Turning to FIGS. 4 and 5, FIG. 4 illustrates the cooling rate ($Q_c$) and FIG. 5 illustrates the Coefficient of Performance (COP) under a transient state in accordance with embodiments of the present invention. FIGS. 4 and 5 illustrate percentage difference of the cooling rate ($Q_c$) and COP of the thermoelectric assemblies for varying operative conditions in a transient regime. In performance profiles displayed in FIGS. 4 and 5, pulsing 409 and 509 is applied at around 60 s from the recording of the data.

Table 1 below summarizes the percentage difference of cooling from steady state as seen with varying PD and PI.

TABLE 1

| Example | No. of Assemblies | PD (s) | PI (s) | % $Q_c$ (Difference of Cooling) | Increase In COP When Pulsing |
|---|---|---|---|---|---|
| 401, 501 | 1 | 5 | 20 | 0.4% | 8.8% |
| 402, 502 | 1 | 10 | 20 | 0.7% | 9.5% |
| 403, 503 | 1 | 15 | 20 | −2.4% | 8.5% |
| 404, 504 | 1 | 10 | 10 | −1.8% | 11.6% |
| 405, 505 | 1 | 10 | 20 | −0.7% | 9.5% |
| 406, 506 | 1 | 10 | 30 | −0.2% | 8.7% |
| 407, 507 | 2 | 10 | 20 | −2.9% | 32.8% |
| 408, 508 | 2 | 20 | 10 | −4.1% | 40.1% |

As seen above in Table 1, when pulsing is applied to one thermoelectric assembly 409 and 509, the thermoelectric assembly provides higher COP (i.e., operates more efficiently) when pulsed, while providing the same amount of cooling. Thus, in accordance with the present invention, less energy is used to achieve the same amount of cooling. When pulsing is applied to two thermoelectric assemblies connected in series (cascading) 409 and 509, the average differences in COP from constant current are substantially higher than for a single thermoelectric assembly, because pulsing occurs when the thermoelectric assemblies can operate with greater efficiency. The slight decreases in cooling rate (i.e., $Q_c$) of the magnitude seen in Table 1 are minimal as compared to the significant increase in the COP when using pulsing current.

Figure 6:
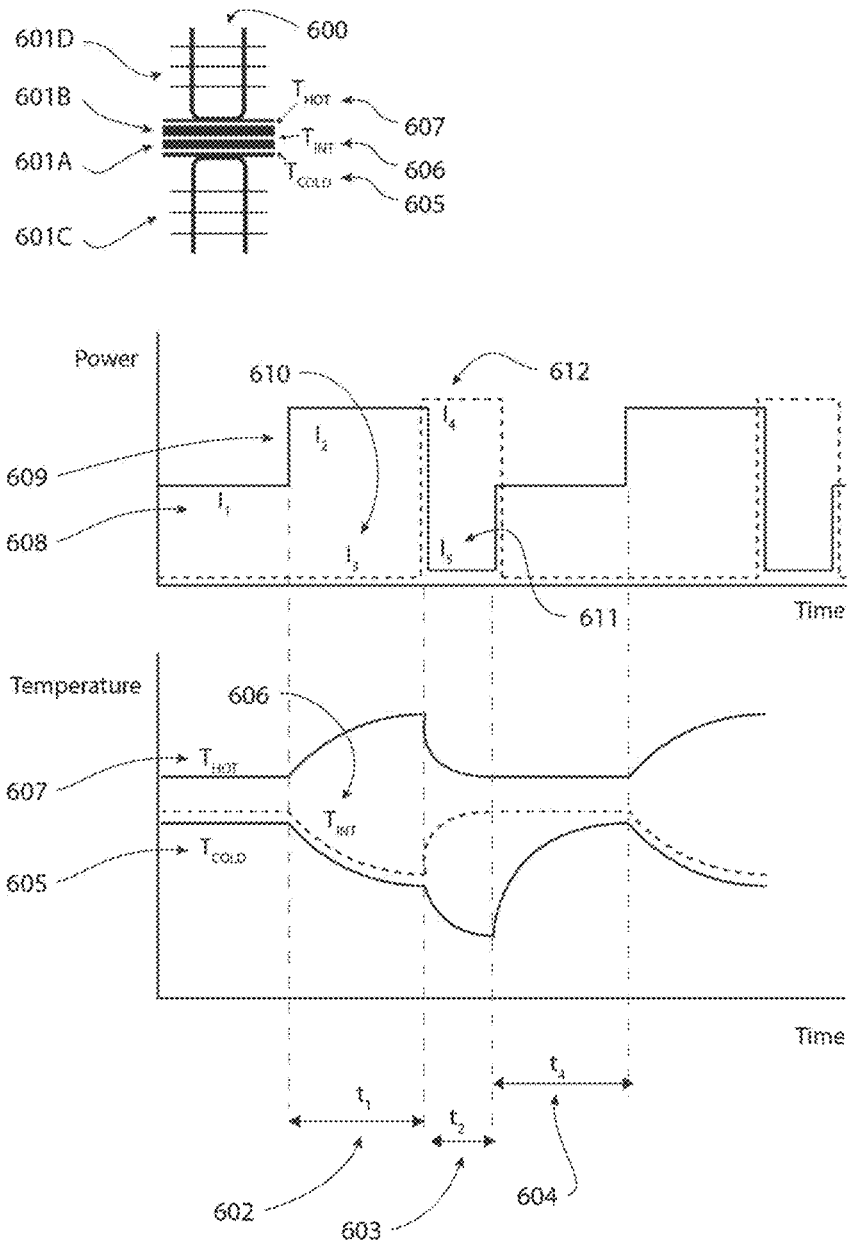
FIG. 6 is an illustration of the change in temperatures at the two sides of two-stacked thermoelectric modules comprising one thermoelectric assembly and within the intermediate zone separating the two stacks of thermoelectric modules induced by pulsing electrical current through the thermoelectric assembly using a square waveform in accordance with embodiments of the present invention.

Turning to FIG. 6, an illustration of the effect of pulsing of electric current on temperature is shown for one thermoelectric assembly comprising two stacked thermoelectric modules 601A, 601B with two heat exchangers 601C, 601D. The cold side of the bottom thermoelectric module 601A is in contact with the cold-side heat exchanger 601C. The hot side of the top thermoelectric module 601B is in contact with the hot-side heat exchanger 601D.

In embodiments, thermoelectric assembly 600 has two thermoelectric modules stacked on top of each other 601A and 601B, where the hot side of the bottom thermoelectric module 601A has the same temperature $T_{INT}$ 606 of the cold side of the top thermoelectric module 601B. Under steady conditions, the top thermoelectric module 601B is powered with a current $I_1$ 608 for which there is a certain temperature differential between $T_{HOT}$ 607 and $T_{INT}$ 606. Also under steady conditions, the cold side temperature $T_{COLD}$ 605 of the bottom thermoelectric module 601A is the same or very similar to the intermediate temperature $T_{INT}$ 606, assuming that the bottom thermoelectric module 601A is powered with a current $I_3$ 610 that is close to zero. Under steady conditions, the temperatures of the hot side 607 and cold side 605 of thermoelectric assembly 600 depends on the electrical current $I_1$ 608 and $I_3$ 610.

In embodiments with two stacked thermoelectric assemblies, electric current $I_2$ 609 is provided to the top module 601B of the stack for a duration $t_1$ 601, while the electrical current $I_3$ 610 provided to the bottom module 601A is kept minimal. This causes the temperature differential to increase as the temperature at the hot side of the top thermoelectric assembly increases. The cold side temperature 605 of bottom thermoelectric module 601A decreases in temperature similarly to the intermediate temperatures $T_{INT}$ 606 because thermoelectric modules have high thermal conductivity. As the temperature differential increases, the efficiency of the thermoelectric assembly decreases. When the electrical pulse $I_2$ 609 is reduced to a minimal value $I_5$ 611, then the temperature of the hot side of the thermoelectric assembly 607 decreases. Under this condition, an electrical pulse $I_4$ 612 is provided to the bottom thermoelectric module 601A, which generates a temperature differential between temperature $T_{COLD}$ 605 of the cold side of the bottom thermoelectric module and the temperature $T_{INT}$ 606 at the interface between the two thermoelectric modules. The electrical pulse $I_4$ 612 increases the overall temperature differential between $T_{COLD}$ 605 and $T_{HOT}$ 607 yielding a higher heat transfer rate.

When the pulsing of the thermoelectric modules is restored to the initial value $I_1$ 608 for the upper thermoelectric module 601B and $I_3$ 610 for the bottom thermoelectric module 601A, the temperature of the hot and cold sides gradually converges to the steady state condition. In the embodiment illustrated in FIG. 6, there are two Pulsing Intensities (PI) 602 and 608, and there is one Pulsing Duration (PD) 604. The control unit in accordance with embodiments of the present invention increases the overall temperature differential across the hot and cold side of the thermoelectric assembly without reducing the efficiency of the system.

Figure 7A:
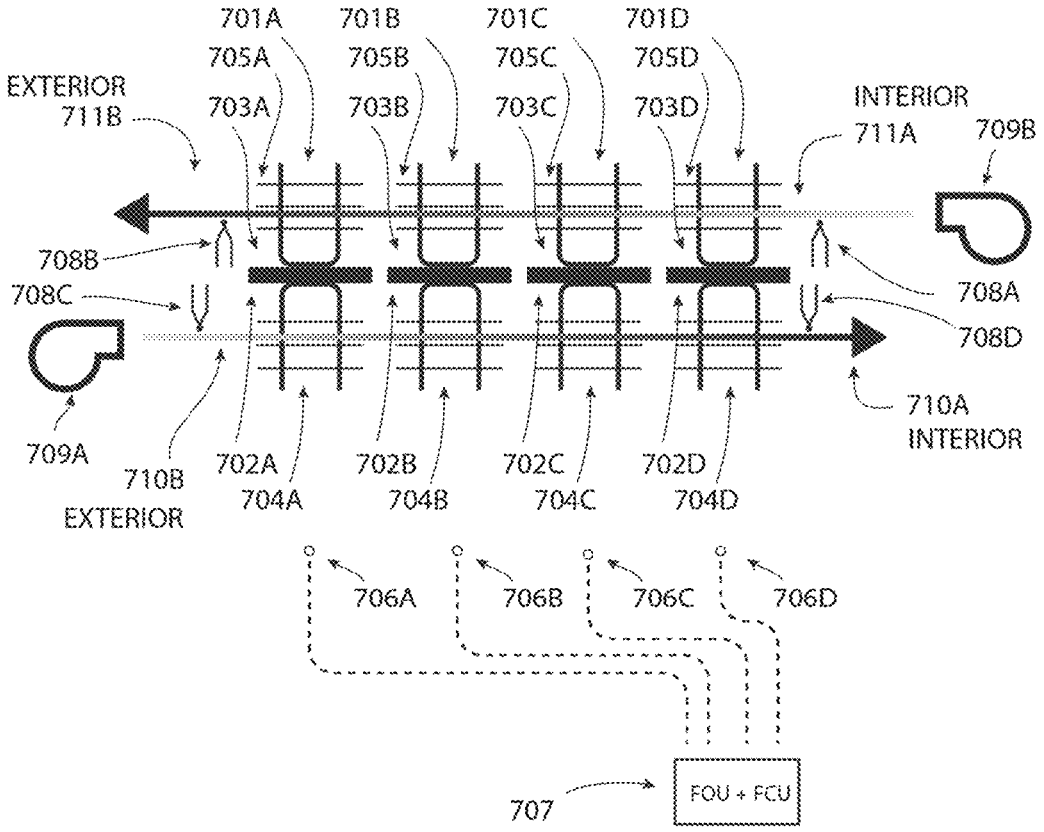
FIG. 7A is a schematic illustration of a basic system configured in accordance with embodiments of the present invention.

Turning to FIG. 7A, an illustration is shown for an HVAC system with thermoelectric assemblies 701A, 701B, 701C, 701D, controlled and operated by FOU and FCU 707 in accordance with an embodiment of the present invention. In the embodiment shown in FIG. 7, heat is required to be removed from a habitable space (interior 710A) and there are four thermoelectric assemblies, 701A, 701B, 701C, 701D, connected in series (also known as with a cascading effect). Each thermoelectric assembly has a cold side 702A, 702B, 702C, 702D in contact with the respective cold side heat exchangers 704A, 704B, 7040, 704D. Each thermoelectric assembly has a hot side 703A, 703B, 703C, 703D, with hot side heat exchangers 705A, 705B, 705C, 705D. Air is forced by fan 709A across the cold side heat exchangers 704A, 704B, 7040, 704D, and by fan 709B across the hot side heat exchangers 705A, 705B, 7050, 705D of the thermoelectric assemblies in a counterflow direction to keep the temperature differentials across each thermoelectric assembly equal. When the air is circulated in the counterflow direction, cooling is provided to interior 710A from exterior 710B, while heat is rejected to the exterior 711B from interior 711A.

To provide enough cooling capacity and maximize the coefficient of performance, control unit 707 (including both FOU and FCU) will determine the desired temperature setpoint (to ultimately be measured at sensor, i.e., thermocouple) 708D and the heat to be rejected based on outdoor air temperature measured at sensor 708C. Additionally, control unit 707 determines the air temperature of the occupied space through sensor 708A and predicts the air temperature at the exhaust (measured by sensor 708B) to calculate the amount of power to be supplied to the thermoelectric assemblies. When these values are determined, control unit 707 provides pulsing power to each thermoelectric assembly depending on how much heat transfer and temperature differential needs to be obtained.

In the embodiment shown in FIG. 7, control unit 707 provides pulsing currents 706A, 706B, 706C, 706D independently to thermoelectric assemblies 701A, 701B, 701C, and 701D. Control unit 707 regulates the necessary power to be provided to the thermoelectric assemblies and air flow 709A to reach the desired indoor temperature setpoint to be measured at sensor 708D.

In embodiments, constant electrical current is applied independently to the thermoelectric assemblies. In embodiments, the pulsing at each thermoelectric assembly can be of the same PD and PI. In embodiments, the pulsing at each thermoelectric assembly can be of a varying PD and PI. In embodiments, the same electrical pulsing current is applied across each thermoelectric assembly.

Once the indoor conditions reach the desired temperature (as measured at sensor 708D), control unit 707 will reduce the power supplied to thermoelectric assemblies 701A, 701B, 701C, 701D, and fans 709A and 709B.

In embodiments, there may be the need to provide heating to the occupied space, hence increasing the air temperature from exterior 710B to interior 710A and sourcing the heat from the exterior by lowering the air temperature from interior 711A to exterior 710B. Under these conditions, control unit 707 will regulate the necessary power to be provided to the thermoelectric assemblies and air flow 709A to reach the desired indoor temperature setpoint to be measured at sensor 708D. However, in an embodiment where the interior is being heated, the polarity of the electrical pulses 706A, 706B, 706C, 706D will be reversed.

Figure 7B:
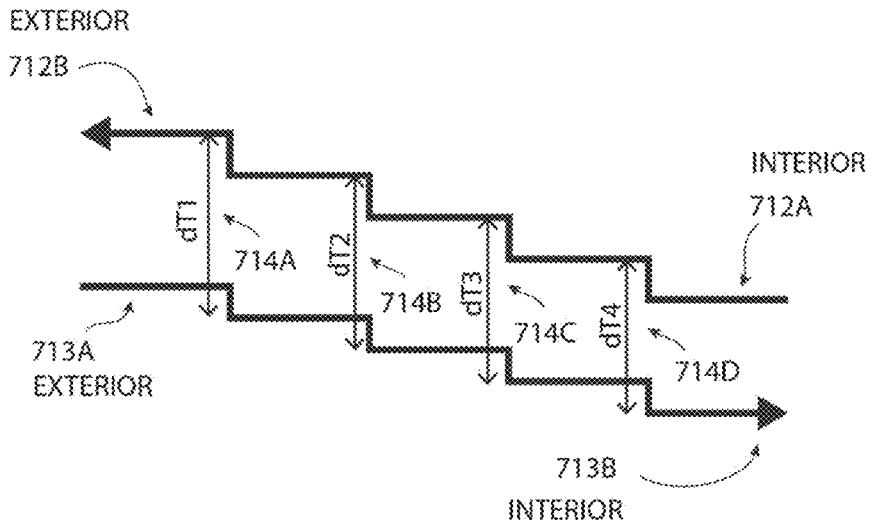
FIG. 7B illustrates the temperature profiles, and in particular the cascading effect of temperature observed during a cooling operation, across the four thermoelectric assemblies illustrated in FIG. 7A in accordance with embodiments of the present invention.

Turning to FIG. 7B, the temperature profiles across the four thermoelectric assemblies of FIG. 7A, arranged in a cascading effect, are illustrated in a cooling condition. In this exemplary embodiment, exterior air temperature 713A entering the first thermoelectric assembly (as measured by sensor 708C shown in FIG. 7A) is 35° C. Inside air temperature 712A, entering the fourth thermoelectric assembly (as measured by thermocouple 708A shown in FIG. 7A) is 26.7° C. The supply air temperature 708D in the occupied space is generally specified by the occupant and is set at 21° ° C. in this embodiment. The temperature of the air exhausted through the last thermoelectric assembly 712B is the result of the temperature drop after the air passes through the four thermoelectric assemblies (i.e., assemblies 701A, 701B, 701C, and 701D shown in FIG. 7A), which is dependent on the amount of heat removed from the room and the amount of energy spent to do that.

In the embodiment illustrated in FIG. 7B, the thermoelectric assemblies are powered with the same pulsing current. In this embodiment, the temperature differentials after passing through each thermoelectric assembly (i.e., dT1 714A, dT2 714B, dT3, 714C, dT4, 714D), are the same, however their absolute values gradually decrease between the temperatures at the supply (i.e., 713B) and exhaust of the system (i.e., 712B).

In embodiments (not shown) where each thermoelectric assembly is operated with different pulsing currents, the resultant temperature differentials 714A, 714B, 7140, and 714D vary. This effect leads to more efficient thermoelectric assemblies. FCU (control unit 707 as shown in FIG. 7A) modulates the temperature differentials within each thermoelectric assembly to reach the best performance at the system level. In embodiments, the FCU provides different pulsing currents to some modules to increase the amount of heat removed or supplied to the room, to decrease the temperature at the supply 713B of the occupied space.

In other embodiments, the FCU provides different pulsing currents to some of the modules to dehumidify the air below the dew point. In other embodiments, the polarity of the current is reversed to provide heat to the occupied space while still pulsing each thermoelectric assembly with the same or different pulsing duration or intensity.

Figure 8:
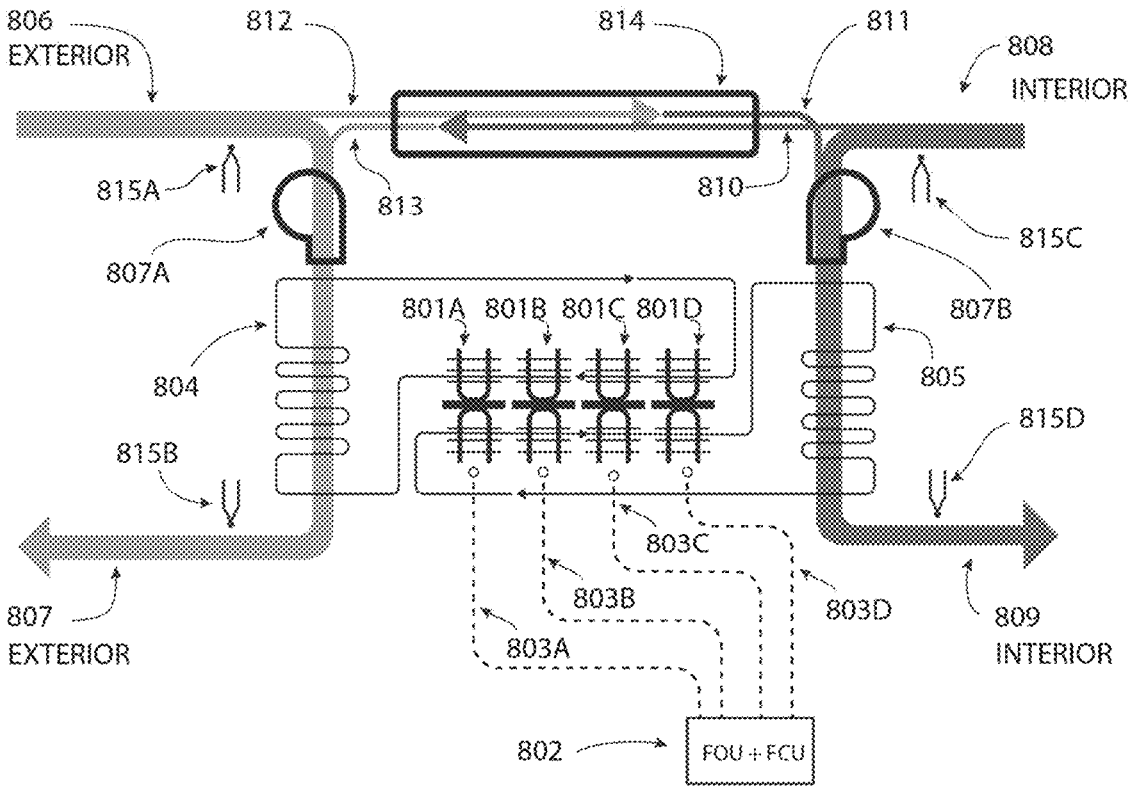
FIG. 8 is a schematic illustration of an HVAC system configured in accordance with embodiments of the present invention.

Turning to FIG. 8, a schematic illustration is shown for an HVAC system configured with four thermoelectric assemblies in accordance with an exemplary embodiment of the present invention.

The HVAC system of the embodiment shown in FIG. 8 comprises four counter-flow thermoelectric assemblies 801A, 801B, 801C, and 801D. Each thermoelectric assembly (similar to the assemblies shown in FIGS. 1 and 7A) includes one or more thermoelectric modules and two heat exchangers per assembly. While four thermoelectric assemblies are illustrated in FIG. 8, one of ordinary skill in the art would recognize that any number of thermoelectric assemblies can be used (such as illustrated in FIG. 1) depending on the final heating or cooling capacity of the system. In embodiments with four counter-flow thermoelectric assemblies, such as illustrated in FIG. 8, each thermoelectric assembly can generate 375 W of cooling, resulting in a nominal system capacity of 1.5 kW.

Additionally, one of ordinary skill in the art would recognize that the specific characteristics of the thermoelectric modules in terms of thickness, number of legs, size and materials, are determined in accordance with the overall system capacity and thermal resistance of the heat exchangers.

In an embodiment where the HVAC unit is cooling, a finned heat exchanger 805 is designed to provide cooling from all cold sides of the thermoelectric assemblies heat exchangers to the interior space. Heat exchanger 804 is designed to reject heating from all hot sides of the thermoelectric assemblies heat exchangers to the outside. In embodiments, the fluid (not shown) flowing through heat exchangers 804, 805, and the heat exchangers of all thermoelectric assemblies will have low viscosity and a freezing point below −20° C. In embodiments where the polarity is reversed, the cold side of the thermoelectric assembly will function as the hot side of the thermoelectric assembly and the hot side of the thermoelectric assembly will function as the cold side of the thermoelectric assembly.

As the counter-flow thermoelectric assemblies engage with heat transfer for either heating or cooling purposes, the fluid flowing through heat exchanger 805 transfers heat from all cold-side heat exchangers of the thermoelectric assemblies 801A, 801B, 801C, 801D to the heat exchanger 805, while it undergoes changes in temperatures directly proportional to the cooling or heating rate developed through each stage. Also, the fluid flowing through heat exchanger 804 transfers heat from all hot-side heat exchangers of the thermoelectric assemblies to the heat exchanger 804, and it undergoes changes in temperatures directly proportional to the cooling or heating rate developed through each stage. In this manner, the temperature differentials across each stage are controlled to provide the optimal heat capacity, efficiency, and desired temperature perceived by the occupant.

In the embodiment shown in FIG. 8, liquid fluid flowing through heat exchanger 805 exchanges heat with the air of occupied space (i.e, interior) 808 forced by fan 807B through air-side heat exchanger 805, to supply a colder temperature supplied in the interior space 809. Similarly, the liquid fluid rejects heat from outside (i.e., exterior) air 806 forced by fan 807A through air-side heat exchanger 804, to generate a higher temperature exhausted at exhaust 807. In this exemplary embodiment, the air flow rate at the supply 809 and exhaust 807 are 1,200 cubic feet per minute (CFM). In other cases, the air flow rate can be changed to a lower or greater value as specified by the use, typically within a range of 500 CFM to 1,900 CFM.

In embodiments, a percentage of exterior air 806, coming from outside air supply 812, is mixed with the air from occupied space 808 to increase the indoor air quality. In contrast, the same or smaller percentage of interior air 810 is exhausted to the outside. The temperature of the outside fresh air 812 and exhausted air 810 are recuperated through heat exchanger 814 to increase the efficiency of the system. In this example, the air flow rates of the fresh and exhausted air are 50 CFM, and typically are in the range of 0 to 200 CFM.

In the embodiments shown in FIG. 8, the operating conditions of thermoelectric assemblies 801A, 801B, 801C, and 801D are controlled by control unit 802. Control unit 802 hosts the FCU and FOU to determine the best COP based on the approach of the present invention and illustrated in FIG. 1. More specifically, the FOU within control unit 802 registers the user input, air flow rate, and the desired temperatures at the supply 815D. The FOU determines the indoor temperature at 815C and the ambient temperature at 815A. The FOU determines the temperature exhausted at 815B to calculate COP. Electrical currents 803A, 803B, 803C, and 803D provided to the thermoelectric assemblies from control unit 802 are modulated based on the temperature differentials across the thermoelectric device, which is representative of the amount of required heating or cooling and the efficiency with which it is provided.

In embodiments, the control logic for control unit 802 uses a multi-objective regression to modulate how much heat is provided to or removed from the room, based on the overall efficiency of the system. The control unit directly correlates the modulation based on the occupants' perception of the space, the air temperature supplied to the space and its air velocity, factors affecting thermal comfort.

Thermoelectric assemblies 801A, 801B, 801C, and 801D operate using the same or different conditions. In an embodiment where room cooling occurs, the modules can be operated to respond to the ambient and room condition to deliver an appropriate cooling capacity based on the previous condition that a user deemed opportune. In embodiments, the thermoelectric assemblies operate to dehumidify by reaching a temperature lower than dew point.

By determining the operative temperatures of the fluids used within heat exchangers 804 and 805, and the power provided to the thermoelectric assemblies, control unit 802 computes the power consumption and the effectiveness of heating or cooling. By adjusting any of these parameters, control unit regulates the heat removed or supplied to the space. By alternating the power to the thermoelectric assemblies, control unit 802 modulates the air temperature and relative humidity within the habitable space.

It is anticipated and within the scope of the invention that the invention is applicable for use on any occupied spaces that need to regulate the air temperature and relative humidity to make the space healthier and more comfortable to occupants. It is also anticipated that the occupied space may be within a building, an automotive, maritime, or aerial vehicle. The occupied space may include one occupant, multiple performing similar activities (such as residential building), or multiple under different thermal comfort conditions (such as operating rooms in hospitals or clinics) for which providing personalized thermal experiences is necessary.

Now that embodiments of the present invention have been shown and described in detail, various modifications and improvements thereon will become readily apparent to those skilled in the art. Accordingly, the exemplary embodiments of the invention, as set forth above, are intended to be illustrative, not limiting. The spirit and scope of the present invention is to be construed broadly.

What is claimed is:

1. A controller adapted for controlling a thermoelectric assembly, the controller comprising an input configured to receive power to power the controller, the sensors, and the thermoelectric assembly of the present invention;

an output configured to supply power to the thermoelectric assembly;

a processor configured to control the power that is supplied to the thermoelectric assembly connected to the controller using dynamic intermittent pulses that are unique in intensity and duration for a specific moment in time;

wherein the thermoelectric assembly has a coefficient of performance defined by the cooling or heating rate divided by the power supplied to the thermoelectric assembly; and wherein the processor is configured to maximize the average coefficient of performance of the thermoelectric assembly using the intermittent pulses.

2. The controller of claim 1, where the processor supplies power to the thermoelectric assembly in a plurality of intermittent pulses only.

3. The controller of claim 2, wherein the intermittent pulses are supplied for a duration in a range of 5 to 20 seconds with an interval of 10 to 20 seconds between each consecutive pulse of the intermittent pulses.

4. The controller of claim 3 wherein the duration of or interval of the intermittent pulses is adjusted to increase the coefficient of performance of the thermoelectric assembly.

5. A method of controlling a thermoelectric assembly, the method comprising the steps of:

powering a controller using a power supply;

using a controller powered by the power supply to power the thermoelectric assembly;

wherein the power from the controller is supplied using a plurality of intermittent pulses, wherein the intermittent pulses are unique for a specific moment in time, wherein the thermoelectric assembly has a coefficient of performance defined by the cooling or heating rate divided by the power supplied to the thermoelectric assembly, and wherein the controller determines the intermittent pulses to maximize the average coefficient of performance of the thermoelectric assembly when the power is supplied to the thermoelectric assembly using the intermittent pulses.

6. The method of claim 5 wherein the intermittent pulses are supplied for a duration in a range of 5 to 20 seconds with an interval of 10 to 20 seconds between each consecutive pulse of the intermittent pulses.

* * * * *